United States Patent [19]

Coons

[11] 4,133,138

[45] Jan. 9, 1979

[54] BUBBLE FORMING AND PROJECTING DEVICE

[76] Inventor: Scott Coons, 5511 Erlands Pt. Rd., Bremerton, Wash. 98310

[21] Appl. No.: 778,508

[22] Filed: Mar. 17, 1977

[51] Int. Cl.[2] ..... A63H 33/28

[52] U.S. Cl. ..... 46/6; 46/8

[58] Field of Search ..... 40/120; 46/6, 7, 8

[56] References Cited

U.S. PATENT DOCUMENTS

| | | | |
|---|---|---|---|
| 2,133,499 | 10/1938 | Dolan | 46/8 |
| 2,547,825 | 4/1951 | King | 46/8 |
| 2,746,205 | 5/1956 | Raizen | 46/7 |
| 2,813,361 | 11/1957 | Consolo | 40/126 |
| 3,021,639 | 2/1962 | Allen et al. | 46/7 |
| 3,123,936 | 3/1964 | Feltman | 46/8 |
| 4,016,673 | 4/1977 | Constance | 46/6 |

*Primary Examiner*—Louis G. Mancene
*Assistant Examiner*—Robert F. Cutting
*Attorney, Agent, or Firm*—Graybeal, Barnard & Uhlir

[57] ABSTRACT

A base supports a chamber having an upper portion that defines an air exit aperture, a middle portion that has a plurality of air entry apertures and a closed, lower portion that forms a soap solution reservoir. An apertured, bubble forming ring is mounted within the chamber for rotation about a horizontal axis and has its lower portion extending into the soap solution reservoir. An air impeller is mounted within the bubble forming ring for rotation about a vertical axis. When the toy is actuated, the apertured bubble forming ring carries films of soap solution from the reservoir into the upward air current emitted by the air impeller to form a multitude of upwardly projected bubbles.

26 Claims, 7 Drawing Figures

Fig. 3
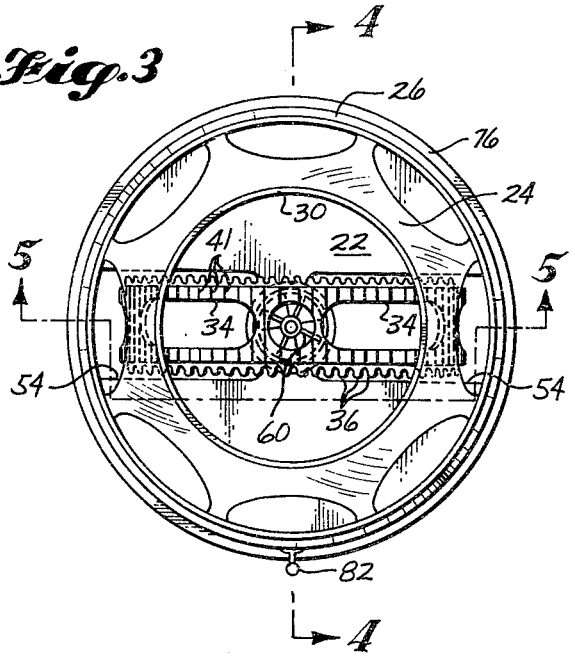
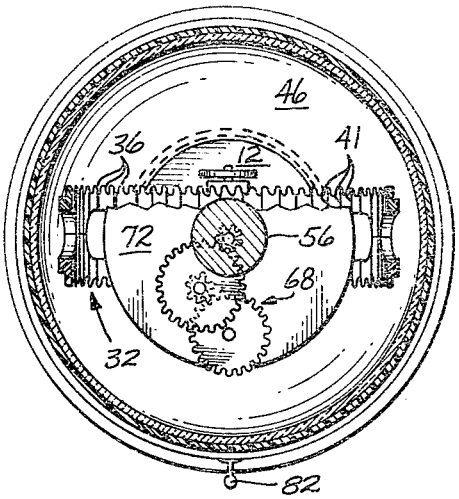
Fig. 6
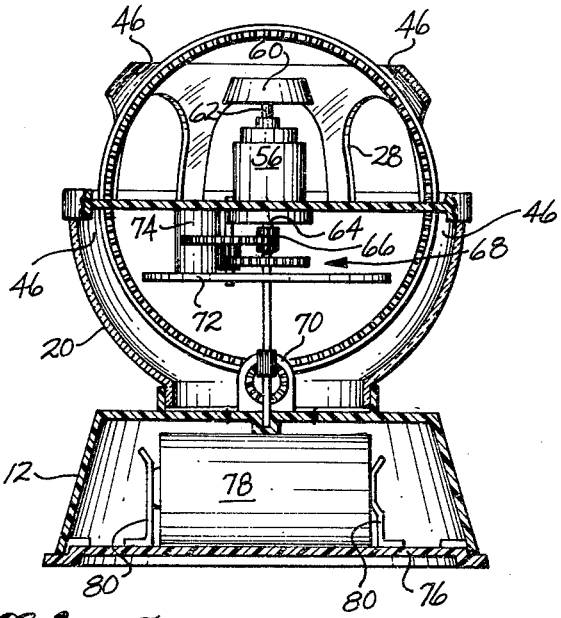
Fig. 5
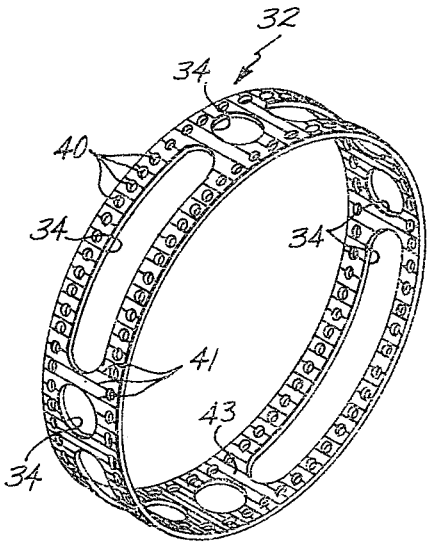
Fig. 7

BUBBLE FORMING AND PROJECTING DEVICE

BACKGROUND OF THE INVENTION

1. Field of the Invention

The present invention relates to bubble producing toys or machines, and more particularly to mechanical, bubble forming and projecting devices actuated either manually or electrically and utilizing an apertured, bubble forming ring.

2. Description of the Prior Art

Bubble producing devices, ranging from simple toys to relatively complex mechanical contrivances are generally well-known and may produce a variety of forms of bubbles. Some devices form a sheet-like mass of bubbles or foam, as is disclosed by U.S. Pat. No. 2,133,499, granted to Dolan, Oct. 18, 1938. Other devices form discreet bubbles which are set free into the air and may include a separate fan to project the bubbles away from the machine, as is disclosed by U.S. Pat. No. 2,813,361 granted to Consolo, Nov. 19, 1957. However, such "professional" devices as Consolo's are generally cumbersome, complex, costly and are neither suited nor adapted for use by a child.

On the other hand, toy bubble machines such as disclosed by U.S. Pat. No. 3,021,639, granted Feb. 20, 1962 to Allan et al, and U.S. Pat. No. 2,746,205, granted May 22, 1956 to Raizen, suffer from the drawback that the bubbles are formed solely from the breath of the child blowing into the device. Since a child's lung capacity is small, relatively few bubbles can be formed, and repeated efforts may soon result in a tired and disheartened child. Further, if no provision is made in these toy bubble machines for projecting the bubbles away from the toy, the bubbles will generally begin to settle to earth immediately after issuing from the device. Such a lackadaisical performance can be a great disappointment to both the child and to any observers present.

The details of the mechanisms used to generate discreet bubbles varies, and may include some form of apertured conveyor that is used to transport films of soap solution from a soap solution reservoir into a stream of compressed air emitted from a nozzle located within the conveyor. As Consolo, Allan and Raizen disclose, the apertured, bubble forming conveyor rides on a shaft and is supported by spokes or a wall. In addition, some sort of compressed air conduit and nozzle for delivering compressed air from the compressed air source to the apertured conveyor is also used. Such use of a shaft, spokes or support wall, compressed air conduit and nozzle results in a relatively complex, hard to mold device, which causes higher costs and makes mass production more difficult.

BRIEF SUMMARY OF THE INVENTION

The bubble forming and projecting toy of the present invention comprises, in basic form, a housing that includes a base and a chamber. The chamber is supported by the base and has a lower portion which forms a reservoir for bubble forming liquid, a middle portion which is perforated by a plurality of air entry holes to permit entry of air into the chamber, and an upper portion which defines an air exit aperture. An apertured bubble forming ring is supported by the chamber and is mounted for rotation about a horizontal axis such that its lower portion dips into the reservoir. An air impeller is mounted for rotation about an axis that passes substantially through the center of the air exit aperture.

When the toy is actuated, drive means rotate both the air impeller and the apertured bubble forming ring. The bubble forming ring conveys films of bubble forming liquid from the reservoir into the current of air projected generally upwardly by the air impeller, thereby forming and projecting into the air a host of bubbles.

Some aspects of the present invention emphasize various features of the bubble forming ring and include specifying it to have several sizes of bubble forming apertures to enhance its ability to readily form multisized bubbles. Further, engaging means to engage the drive means may be provided on one or both of its lateral edges and may comprise spaced holes or gear teeth. In another aspect, the ring is specified to be floating in that it lacks a support shaft, but is supported through the contact of its external surface with the surrounding structure. Further, the ring may be specified as symmetrical in order to facilitate its manufacture in strip form from molded plastic whereby the symmetrical halves may be glued together to form the completed ring. In another aspect, the external or internal surface of the ring may be provided with a parallel groove to enhance the ability of the ring to carry bubble forming liquid.

Other aspects of the present invention specify the drive means to include a substantially vertically oriented electric motor whose upwardly projecting drive shaft directly engages the air impeller to support and rotate it. Further, the electric motor's drive shaft may be elongated downwardly so that its lower end drives the apertured bubble forming ring through a gear train.

Some aspects of the bubble forming and projecting toy of the present invention emphasize various features of the housing, and include specifying the chamber to be substantially spherical. In addition, a platform may be specified which is coplanar with the air exit aperture and upon which the drive means may be secured. Finally, the chamber may comprise upper and lower halves and the platform may be specified as horizontal and located adjacent their intersection.

It is a principal object of the present invention to provide a mechanical bubble toy which not only forms bubbles of a variety of sizes, but also projects them upwardly and outwardly from the toy. It is a further object to amuse and delight the user by providing a floating, apertured, bubble forming ring to convey bubble forming liquid from a reservoir in the base of the toy into the air stream emitted by the air impeller, which mechanism may be made visible by forming the chamber from clear plastic. A further object of the present invention is to provide a relatively low cost, easy to manufacture mechanical bubble producing toy.

BRIEF DESCRIPTION OF THE DRAWING

FIG. 3 is a top elevational view thereof;

FIG. 5 is a cross-sectional view of the toy illustrated in FIG. 3 taken substantially along line 5—5 thereof;

FIG. 6 is a cross-sectional view of the toy illustrated in FIG. 4 taken substantially along line 6—6 thereof; and FIG. 7 is a perspective view from an upper aspect of another embodiment of the apertured bubble forming ring of the bubble forming and projecting toy of the present invention.

DESCRIPTION OF THE PREFERRED EMBODIMENT

Figure 1:
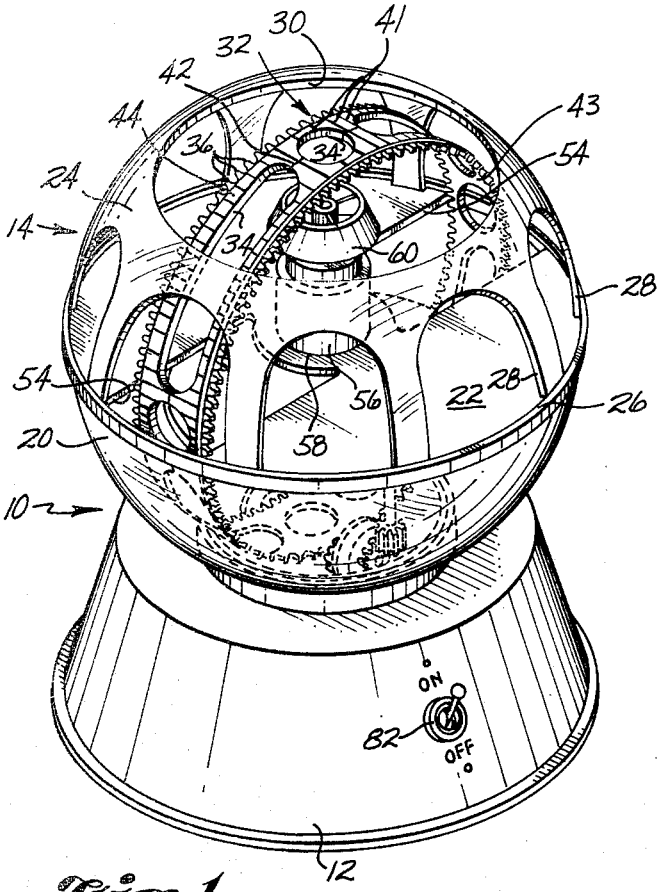
FIG. 1 is a front perspective view from an upper aspect of the bubble forming and projecting toy of the present invention.
Figure 4:
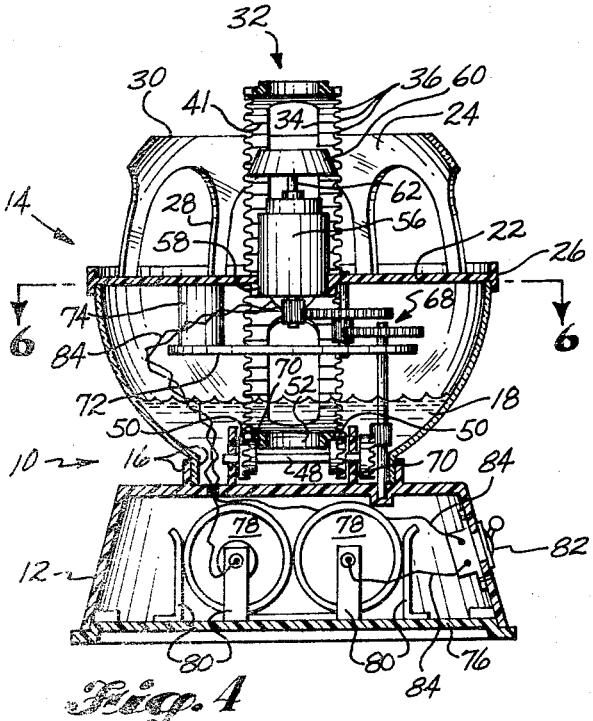
FIG. 4 is a cross-sectional view of the toy illustrated in FIG. 3 taken substantially along line 4—4 thereof.

With reference now to the drawings, and first to FIGS. 1 and 4 thereof, a preferred embodiment of the bubble forming and projecting toy constructed in accordance with the present invention is shown to include a housing, generally designated at 10, which includes a base 12 and an open bottomed chamber 14, wherein the lower portion 20 of the chamber is secured to the top of the base, as cementing, to form a reservoir for the bubble forming liquid 18. As shown, both the base and the chamber may each include a flange 16 which, when cemented together, form a liquid-proof seal. Alternatively, the reservoir may be defined by the lower portion 20 of the chamber being formed with a closed bottom, not illustrated, which is then secured, as by cementing, to the top of the base.

As best seen in FIG. 4, the chamber is generally spherical, although it may be made in any other suitable shape such as a polyhedron, or, even as an amusing caricature of some object, as for example, an animal's head. The chamber comprises a lower portion 20; a generally horizontal platform 22, which overlies and is secured to the lower portion; and an apertured upper portion 24 which is secured to the top of the horizontal platform. As is seen, the platform includes a peripheral flange 26 which engages both the top of the lower portion 20 of the chamber and the bottom of the upper portion 24 of the chamber. All these members may be secured together by cementing, but it is preferred that they be joined by a friction or snap fit to enhance the ability of the toy to be disassembled for filling, repair or cleaning. The upper portion 24 includes a plurality of air admitting apertures 28 spaced about its periphery, and an air exit aperture 30 located on its top.

A bubble forming ring 32 having a diameter slightly less than the diameter of the chamber 14 is carried within the chamber for rotation about a substantially horizontal axis. Spaced about the periphery of the ring are a plurality of apertures 34, which are preferred to be of different sizes so that the production of bubbles 38, see FIG. 2, of different magnitudes is enhanced. The ring 32 is shown to have gear teeth 36 spaced along both lateral edges. However, it is possible for the gear teeth to be arranged on only one lateral edge. Alternatively, as shown in FIG. 7, the gear teeth 36 may be replaced by a plurality of small drive holes 40 spaced along one or both of the ring's lateral edges. Preferably, the ring 32 is molded in one piece without the apertures 34, which are subsequently cut therefrom by a die or other suitable means. Alternatively, the ring is formed so that it is symmetrical about a radial plane that passes through a line 42 extending along the midpoint of the circumference of the ring. When the ring is symmetrical about this plane, it can be formed by cementing together the corresponding like edges of two identical strips whose ends are then cemented together. Such a form of construction is desirable because it enables the ring to be molded in flat strips which results in a much lower manufacturing cost than if the ring were molded as a circular unit. In addition, a plurality of parallel grooves 41 are formed on the internal and external surfaces 43, 44 of the ring 32 to enhance the ability of the ring to carry more bubble forming liquid, and thus to form more bubbles. Of course, these grooves 41 are not a necessity and may be eliminated or formed on only one of the surfaces 43, 44.

Figure 2:
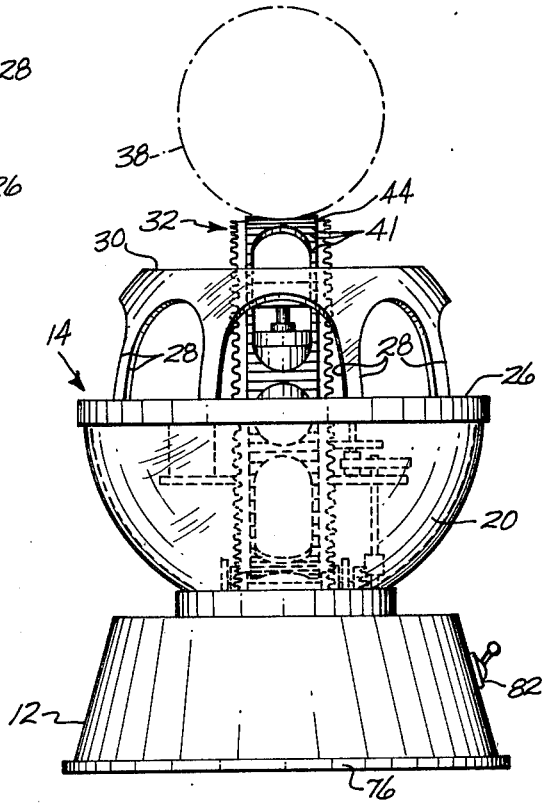
FIG. 2 is a side elevational view thereof.

As best seen in FIGS. 2 and 4, the bubble forming ring 32 projects outwardly through the air exit aperture 30, since its diameter is only slightly less than that of the chamber 14. However, it is certainly possible that the ring could have a smaller diameter than that shown, so that the ring would project outwardly through the air exit aperture to a lesser degree or not at all.

Referring now to FIGS. 1 and 4, the bubble forming ring 32 in the preferred embodiment is shown as floating. That is, it has no internal support shaft, spokes or walls, but is restrained instead by the contact of its external surface 44 with the surrounding structures. Of course, such a support shaft and spokes or walls could be employed, not illustrated, but to do so might detract from the visual and mental impact of the preferred embodiment of the present invention. As seen in FIG. 5, radial support for the ring 32 is provided by contact of the ring's external surface 44 with the inner surface 46 of the chamber; while the majority of the weight of the ring is carried by a support shaft 48 and ring drive gears 50 located beneath the bottom 52 of the ring. Of course, movement of the ring in an axial direction is restrained by the gears 50, and location of the ring in substantially the center of the chamber is provided by journaling the ring support shaft 48 between two lugs 70 which are appropriately positioned. The lugs 70 are secured to the top of the base 12, as by molding or cementing. It is apparent that if the ring were made smaller than is presently shown, as has been previously discussed, the ring would tend to tip radially and come to rest against the inner surface 46 of the chamber. Therefore, in order to keep such a smaller ring centered and untipped within the chamber, supports, not shown, that project inwardly from the inner surface 46 of the chamber would be provided.

As best seen in FIGS. 1 and 3, the horizontal platform 22 contains two diametrically opposed apertures 54 to permit passage of the bubble forming ring 32 through the platform. It is also seen that a vertically oriented electric motor 56, which is mounted as by a friction fit or cementing in a hole 58 located approximately in the center of the platform 22, serves to rotate both the air impeller 60 and the bubble forming ring 32. In the preferred embodiment, the air impeller is mounted, for rotation about a substantially vertical axis, directly to the upper end 62 of the electric motor's vertically oriented drive shaft to ensure simplicity of construction for the toy. As is shown, it is preferred that a shrouded fan be used as the air impeller 60 since such a device has the ability to concentrate and direct the air that it propels, but any other type of air impeller can be used, even a simple propeller. The lower end 64 of the electric motor's drive shaft is secured to a pinion 66 which drives the ring drive gears 50 and support shaft 48 through reduction gearing generally designated at 68. Referring to FIGS. 4 and 5, in order to facilitate mounting of the reduction gearing 68, a secondary platform 72 is provided, along with a spacer 74 which is mounted on the side of the secondary platform generally opposite the reduction gearing.

Although applicant has shown one particular way to mount and drive his air impeller 60 and bubble forming ring 32, the illustrated mechanism is given only by way of example. It is apparent that, without departing from the spirit of applicant's present invention, many other mechanisms will occur to those skilled in the art by which to mount and rotate both the air impeller 60 and the bubble forming ring 32 by using one or more electric motors and various gearing arrangements. In addition, applicant's present invention is easily adapted to non-electric motive power and those skilled in the art will readily see the simple details of how to substitute a hand driven gear train or a spring wound motor for the electric motor 56 shown in the preferred embodiment.

As best seen in FIGS. 4 and 5, the base 12 is hollow and is covered by a base plate 76 which is removably mounted thereto as by a friction fit or threaded connection. Batteries 78 to energize the electric motor 56 are held in mounting brackets 80 secured to the top of the base plate 76. An on-off switch 82 is mounted as by rivets or other suitable means to the side of the base. Electric wiring 84 interconnects the batteries 78, the switch 82 and the electric motor 56, and reaches the electric motor through an aperture 86 in the top of the base 12 which is sealed to prevent leakage of bubble forming liquid into the interior of the base by a drop of rubber cement or the like. If desired, instead of the simple on-off switch 82, a rheostat or other similar means may be provided so that the speed of rotation of the electric motor 56 may be varied to thereby regulate the speed of rotation of the air impeller 60 and the bubble forming ring 32 to thereby vary the number of bubbles 38 produced. Of course, it will be obvious that the electric motor 56 could readily be provided with power from a suitable house electrical outlet, but this is not preferred in order to preclude any chance of shock hazzard to a youthful operator.

To facilitate manufacture and to ensure low cost, it is preferred that most of the components that comprise the bubble forming toy of the present invention be made of plastic, with the chamber 14 being formed of clear plastic to enable the operator to view the working of the mechanism. Of course, a plastic must be selected which is impervious to the bubble forming liquid and will not interact therewith. In this respect, it should be noted that nylon is not an ideal plastic for forming any part coming in contact with the bubble forming liquid since nylon shows a tendency to swell upon contact with moisture. Therefore its use is not preferred for relatively close fitting parts such as the ring 32, the drive gears 50 and the reduction gearing 68.

To operate the toy of the present invention, part of the lower portion 20 of the chamber is filled with bubble forming liquid 18 to a depth sufficient to cover the bottom 52 of the bubble forming ring, but not so deep as to reach the electric motor 56. Then the switch 82 is turned on, thereby supplying electricity to the electric motor 56. As the motor runs, and air impeller 60, carried by the upper end 62 of the electric motor's drive shaft, rotates in a direction such that the air impeller propels a stream of air upwardly through the air exit aperture 30 and bubble forming ring 32. Simultaneously, the pinion gear 66 mounted on the lower end 64 of the electric motors drive shaft engages and rotates the reduction gearing 68, the ring drive gears 50, the ring gear teeth 36, and hence causes the bubble forming ring 32 to rotate about a horizontal axis. Since the lower portion of the ring 32 extends into the reservoir of bubble forming liquid 18 contained in the lower portion 20 of the chamber, as the ring rotates it carries films of bubble forming liquid up out of the reservoir and into the upwardly directed air stream emitted from the air impeller 60. The air stream from the impeller not only causes the bubbles 38 to form, but also projects them outwardly from the bubble forming and projecting toy of the present invention for a not insubstantial distance.

It should be noted that the toy of the present invention shown in FIGS. 1–6 is adapted to project the bubbles it forms substantially vertically upward from the toy. To this end, the air impeller 60 has been mounted on the horizontal platform 22 for rotation about a substantially vertical axis and is centered within the ring 32 so that the current of air it produces is also projected substantially vertically upward through and around the ring. However, it is quite apparent that the present invention can be easily adapted to project bubbles upwardly at an angle from the vertical by forming the air exit aperture 30 so that its plane is tipped from the horizontal to the desired degree. If this is done, it is apparent that for maximum efficiency the axis of the air impeller 60 must also be tipped so that it will propel air through the central portion of the air exit aperture. It will be understood that for whatever angle the bubble toy of the present invention is desired to project bubbles, the essential relationship that must be maintained is that the axis of the air impeller 60 point substantially towards the center of the air exit aperture 30. To maintain this relationship, many expedients will occur to those skilled in the art such as mounting the electric motor 56 at an angle, or securing the platform 22 at the proper, other than horizontal, position. It should be noted that if the bubble toy of the present invention is adapted to be powered by a suitable hand crank and gearing, then it is preferred that the toy be designed to project the bubbles outwardly at an angle rather than vertically, to prevent bubbles from flying into the face of the operator.

From the foregoing, various further applications, modifications and adaptations of the apparatus disclosed by the foregoing preferred embodiments of the present invention will be apparent to those skilled in the art to which the present invention is addressed, within the scope of the following claims.

What is claimed is:

1. A bubble forming and projecting toy comprising:

a housing including a base and a chamber wherein the base supports the chamber, and the chamber has a lower, first portion defining a reservoir suitable for containing bubble forming liquid, a second portion defining an air exit aperture through which air is expelled from the toy, and a third portion defining an air entry means to allow entry of air into the chamber;

a ring having an inner surface, an outer surface and a plurality of bubble forming apertures spaced about its circumference;

ring mounting means secured to the housing for mounting the ring for rotation about a substantially horizontal axis and for locating the lower portion of the ring within the reservoir;

an air impeller;

air impeller mounting means secured to the housing for mounting the air impeller for rotation about an axis that passes substantially through the center of the air exit aperture and for locating the air impeller substantially within the ring; and drive means secured to the housing to cause rotation of the ring and the air impeller about their respective axes, wherein the air impeller draws air into said chamber through said air entry means and propels the air generally upwardly through the ring and the exit aperture.

2. The toy in accordance with claim 1, wherein the bubble forming apertures are of a plurality of sizes to facilitate production of bubbles of unequal size.

3. The toy in accordance with claim 1, wherein the ring further comprises engaging means spaced about and located adjacent to at least one lateral edge of its circumference to engage the drive means.

4. The toy in accordance with claim 3, wherein the engaging means comprise gear teeth that engage a drive gear in the drive means.

5. The toy in accordance with claim 3, wherein the engaging means comprise a plurality of small holes that engage a drive gear in the drive means.

6. The toy in accordance with claim 1, wherein the ring is symmetrical about a plane that bisects the axial length of the circumference of the ring, the ring comprises two identical halves that have their corresponding like portions secured together and each half is a molded plastic strip having its ends secured together.

7. The toy in accordance with claim 1, wherein the ring further comprises a plurality of parallel grooves spaced about at least one of the inner surface and the outer surface of the ring whereby the ability of the ring to carry bubble forming fluid is increased to thereby enable a greater number of bubbles to be formed.

8. The toy in accordance with claim 1, wherein the ring mounting means provide a primary support for the ring and contact primarily only the outer surface of the lower portion of the ring.

9. The toy in accordance with claim 8, wherein the drive means is secured to the housing by a platform passing completely through the ring.

10. The toy in accordance with claim 1, wherein the drive means is an electric motor and wherein the base includes means adapted to removably receive batteries electrically connected to the electric motor through wiring means.

11. The toy in accordance with claim 1, wherein the air entry means comprises a plurality of air admitting apertures spaced about the periphery of the chamber between the lower portion and the air exit aperture.

12. The toy in accordance with claim 1, wherein the chamber is substantially spherical.

13. A bubble forming and projecting toy comprising:

a housing including a base and a substantially spherical chamber wherein the base supports the chamber and the chamber has a lower portion defining a reservoir suitable for containing bubble forming liquid, an upper portion defining an air exit aperture through which air is expelled from the toy, and air entry means to allow entry of air into the chamber;

a ring having an inner surface, an outer surface, a plurality of bubble forming apertures spaced about its circumference, and a diameter less than and substantially equal to the diameter of the chamber so that the top portion of the ring protrudes from the air exit aperture;

said ring being oriented within the housing for rotation about a substantially horizontal axis with its lower portion in the reservoir;

an air impeller;

air impeller mounting means secured to the housing for mounting the air impeller for rotation about an axis that passes substantially through the center of the air exit aperture, and for locating the air impeller substantially within the ring; and drive means secured to the housing to cause rotation of the ring and the air impeller about their respective axes whereby the air impeller propels air upwardly through and about the ring.

14. The toy in accordance with claim 13, wherein the air entry means comprises a plurality of air admitting apertures spaced about the periphery of the chamber between the lower portion and the air exit aperture.

15. The toy in accordance with claim 13, wherein the housing further includes a platform substantially coplanar with the air exit aperture which is secured to the chamber and located above the top of the reservoir and below the air entry apertures.

16. The toy in accordance with claim 13, wherein the drive means is secured to the platform.

17. The toy in accordance with claim 16, wherein the air exit aperture and the platform are substantially horizontal, the drive means includes an electric motor secured to the platform in a substantially vertical orientation, and the electric motor drive shaft directly engages the air impeller and serves as the air impeller mounting means.

18. The toy in accordance with claim 13, wherein the chamber comprises an upper half and a lower half whose intersection lies on a substantially horizontal plane.

19. The toy in accordance with claim 18, wherein a substantially horizontal platform is secured to the chamber substantially at the intersection of the upper and lower halves of the chamber.

20. The toy in accordance with claim 19, wherein the drive means includes an electric motor secured to the horizontal platform in a substantially vertical orientation, and the electric motor drive shaft directly engages the air impeller and serves as the air impeller mounting means.

21. The toy in accordance with claim 13, wherein the ring is mounted within the housing by ring mounting means which contact primarily only the outer surface of the lower portion of the ring, and wherein the ring further comprises engaging means spaced about and located adjacent to at least one laterial edge of its circumference to engage the drive means.

22. The toy according to claim 13, wherein the ring further comprising a plurality of parallel grooves spaced about at least one of the inner surface and the outer surface of the ring whereby the ability of the ring to carry bubble forming fluid is increased to thereby enable a greater number of bubbles to be formed.

23. A bubble forming and projecting toy comprising:

a housing including a base and a chamber wherein the base supports the chamber, and the chamber has a lower portion defining a reservoir suitable for containing bubble forming liquid, an upper portion defining a substantially horizontal air exit aperture through which air is expelled from the toy, and air entry means to allow entry of air into the chamber;

a ring having an inner surface, an outer surface and a plurality of bubble forming apertures based about its circumference;

ring mounting means secured to the housing for mounting the ring for rotation about a substantially horizontal axis and for locating the lower portion of the ring within the reservoir;

an air impeller;

air impeller mounting means secured to the housing for mounting the air impeller for rotation about an axis that passes substantially through the center of the air exit aperture and for locating the air impeller substantially within the ring; and drive means secured to the housing to cause rotation of the ring and the air impeller about their respective axes whereby the air impeller propels air generally upwardly through and about the ring, and wherein the drive means includes an electric motor secured to the housing in a substantially vertical orientation, and the upper end of the electric motor drive shaft directly engages the air impeller, serves as the air impeller mounting means, and mounts the air impeller for rotation about a substantially vertical axis.

24. The toy in accordance with claim 23, wherein the drive means further includes gear train means and wherein the electric motor drive shaft is axially elongated and includes a lower end which is connected to the ring by the gear train means.

25. A bubble forming and projecting toy comprising:

a housing including a base and a chamber wherein the base supports the chamber, and the chamber has a lower portion defining a reservoir suitable for containing bubble forming liquid;

a ring having a plurality of bubble forming apertures spaced about its circumference;

a ring support means which is located beneath the ring and is secured to the housing for supporting the ring for rotation with the lower portion of the ring within the reservoir, wherein said ring support means supports the ring by contact with the outer surface of the bottom portion of the ring;

an air impeller;

an air impeller mounting means secured to the housing for mounting the air impeller for rotation and for locating the air impeller substantially within the ring; and drive means secured to the housing to cause rotation of the ring and the air impeller wherein the air impeller propels air through the ring.

26. The toy in accordance with claim 25, wherein the drive means is secured to the housing by a platform passing completely through the ring.

* * * * *